United States Patent [19]

Phelps, Jr. et al.

[11] 4,062,422

[45] Dec. 13, 1977

[54] ANTIFOULING DAMPING SYSTEM FOR SONAR DOMES

[75] Inventors: Howard N. Phelps, Jr., Coventry, R.I.; Dennis O. Power, Ledyard, Conn.

[73] Assignee: The United States of America as represented by the Secretary of the Navy, Washington, D.C.

[21] Appl. No.: 698,442

[22] Filed: June 21, 1976

[51] Int. Cl.[2] ..... A47B 81/06

[52] U.S. Cl. ..... 181/198; 340/8 D

[58] Field of Search ..... 181/198; 340/80

[56] References Cited

U.S. PATENT DOCUMENTS 3,038,551 6/1962 McCoy et al. ..... 181/198

*Primary Examiner*—Stephen J. Lechert, Jr.

*Attorney, Agent, or Firm*—Richard S. Sciascia; Arthur A. McGill; Prithvi C. Lall

[57] ABSTRACT

Radiated noises from sonar dome structures are reduced by the use of an exterior damping material applied over the dome skin. The damping material is bonded to the outside of a steel sonar dome that is subjected to a seawater environment. An antifouling rubber sheet is bonded over the damping material. The system is particularly applicable to an existing internal punchplate type of sonar dome that does not allow the installation of damping materials on the internal window area of the dome.

2 Claims, 2 Drawing Figures

ANTIFOULING DAMPING SYSTEM FOR SONAR DOMES

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

The present invention generally relates to the reduction of sonar dome radiated noise and more particularly to absorbing flow-induced and hull transmitted vibrations that normally excite a ship's keel mounted sonar dome.

One of the most popular prior methods of reducing the vibration in sonar dome windows comprised the placing of sand in the bottom of the dome. The use of sand has been found, however, to be only partially effective in reducing the vibration of the sonar dome window. Another prior system for damping acoustic enclosures covered a submarine signal device with a synthetic rubberlike material. The inner portion of the covering was cellular. The use of a cellular covering has the drawback of damping the desired tramsmitted and received acoustics signals because of the air filled cells.

Other problems encountered in the past related to the use of antifouling paints. Paints applied to the exterior surface of steel sonar domes had a short life when exposed to the underwater elements and sonar transmissions, and in addition often created noise problems.

SUMMARY OF THE INVENTION

Accordingly, it is a general purpose and object of the present invention to provide an improved damping system for sonar domes. It is a further object to locate the system on the exterior surface of the dome. Another object is that the system has environmental protection by eliminating marine growth. Other objects are that the system have a long life, faired surface for vessel mobility and relatively low in cost. These and other objects of the invention and the various features and details of construction and operation will become apparent from the specification and drawing.

The objects are accomplished in accordance with the present invention by providing an antifouling damping system for sonar domes. The system comprises a layer of damping material bonded to the outside surface of a steel sonar dome with an epoxy adhesive. An antifouling rubber sheet is then bonded over the damping material by means of another adhesive. The damping material acts as an absorber of both flow-induced and hull-transmitted vibrations.

DESCRIPTION OF THE PREFERRED EMBODIMENT

Figure 1:
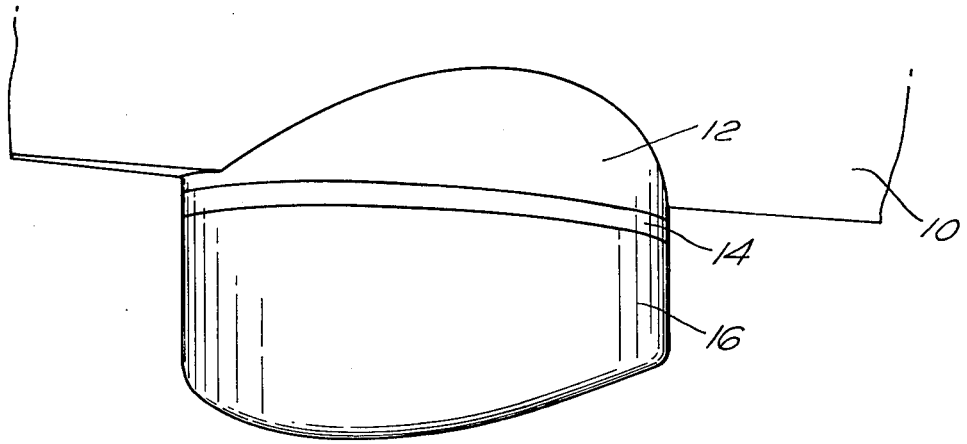
FIG. 1 is a pictorial view of a keel mounted sonar dome including the antifouling damping system of the present invention.

Referring now to FIG. 1 there is shown a keel-mounted sonar dome. A portion of the hull 10 of a ship has affixed to it a dome skirt 12. Underneath and affixed to the skirt 12 is a dome fairing 14. The damped sonar dome 16 forming the lower part of the structure is affixed to fairing 14.

Figure 2:
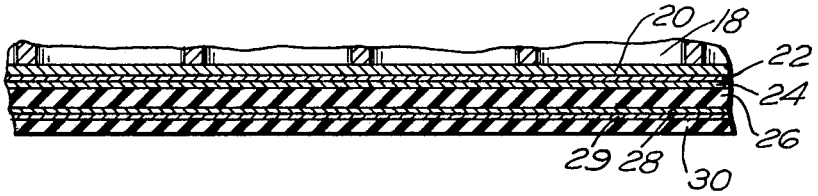
FIG. 2 includes a cross-sectional view of the antifouling damping system affixed to the sonar dome as in FIG. 1.

FIG. 2 shows a partial cross sectional view of dome 16. Within the dome 16 is a punch plate steel structure 18 that is normally welded to a stainless steel plating 20. The structure 18 and plating 20 are well known to those of skill in the art. It is over this plating 20 that the inventive antifouling damping system is applied.

Before applying the system the plating 20 is thoroughly cleaned. In forming the system over the plating 20, an epoxy primer 22 is applied by means of spraying or brushing. Many such suitable primers are commercially available. A commercially available epoxy adhesive 24 is then trowelled on, over the primer 22. A damping material 26 is then rolled on over adhesive 24. The rolling is done to prevent the entrapment of any air from occurring. The damping material 26 is a nitrile based rubber, loaded with calcium carbonate and carbon to increase damping.

A tie coat 28 followed by a neoprene based contact cement 29 is then brushed on the outer surface of the damping material. An antifouling material 30 is then rolled over the cement 29. The antifouling material 30 is known to those of skill in the art and comprises neoprene rubber with tributyltin oxide as the antifouling agent. The material 30 eliminates marine growth on the dome 16. In addition the material 30 can be used over both the dome skirt 12 and dome fairing 14. Obviously suitable primers and bonding agents are applied first to the skirt 12 and fairing 14.

The invention is applicable to keel-mounted steel sonar domes such as those used with the AN/SQS-23 and AN/SQS-56 keel-mounted sonar. The loaded nitrile rubber material 26 for use on these domes contains both calcium carbonate and carbon. The quantity of both the calcium carbonate and the carbon is to be determined on a cut and try basis, depending on frequency of the sonar and temperature of the environment. The material 26 used is approximately one-quarter inch thick and the antifouling rubber sheet has an approximate thickness of eighty thousandths inches. For the sake of clarity the bonding agents shown in FIG. 2 are not drawn to scale.

There has therefore been described an improved damping system for sonar domes that is relatively inexpensive. It was developed for keel-mounted steel sonar domes, but appears applicable to any steel sonar dome, including the bow-mounted steel sonar domes. It is basically designed for use on surface ships, but could be used on submarine steel sonar domes. The antifouling material will provide protection to the sonar dome for at least five years and is compatible for use with the damping material. Thus costs for scrubbing, grooming or repainting sonar domes coated with current paint systems are reduced. A new feature of the invention is that the damping material is applied to the exterior of the sonar dome which means more coverage and less expensive application costs than internally applied damping systems.

An alternative method of reducing the self-noise levels of keel-mounted steel sonar domes would be to replace the entire sonar dome with a rubber sonar dome, an expensive conversion for older ships. The external damping system described in the invention allows the Navy to retain the existing steel sonar domes which results in a cost savings. At present, there are no known alternate effective ways of providing large amounts of inherent damping for the existing steel domes other than that described in this invenion. The reason is that the type of sonar dome that the invention was developed for has an internal punch-plate type of structure which does not allow the installation of damping materials on the internal window area of the dome. Alternate methods do exist for the bow-mounted steel sonar domes; damping materials can be applied to the interior of bow-domes because there is no internal punch-plate structure. However, the internal installation does not allow full coverage of the sonar dome due to the internal dome trusswork; also the internal installation does not provide antifouling protection to the dome exterior.

It will be understood that various changes in the details, materials, steps and arrangement of parts, which have been herein described and illustrated in order to explain the nature of the invention may be made by those skilled in the art within the principle and scope of the invention as expressed in the appended claims.

What is claimed is:

1. An antifouling damping system comprising:

a metallic sonar dome;

a calcium carbonate and carbon loaded nitrile rubber material affixed to and enclosing the exterior surface of said sonar dome; and a neoprene rubber sheet including tribulyltin oxide as an antifouling agent affixed to and enclosing said loaded nitrile rubber material.

2. An antifouling damping system according to claim 1 further including:

a layer of epoxy primer and a layer of epoxy adhesive applied to the exterior surface of said sonar dome for affixing said loaded nitrile rubber material to said dome; and a tie coat followed by a neoprene based contact cement applied to the exterior surface of said loaded nitrile rubber material for affixing said neoprene rubber sheet to said nitrile rubber material.

* * * * *